US005145314A

United States Patent [19]

Westhoff, Jr. et al.

[11] Patent Number: 5,145,314

[45] Date of Patent: Sep. 8, 1992

[54] LOW DRAG PITOT PUMP AND METHOD OF OPERATING SAME

[75] Inventors: Paul E. Westhoff, Jr., Chana; Kent Weber, Rockford, both of Ill.

[73] Assignee: Sundstrand Corporation, Rockford, Ill.

[21] Appl. No.: 687,046

[22] Filed: Apr. 18, 1991

[51] Int. Cl.[5] ..... F01D 0/00; F04D 1/12

[52] U.S. Cl. ..... 415/1; 415/13; 415/20; 415/24; 415/26; 415/88; 415/89; 417/89

[58] Field of Search ..... 45/1, 13, 20, 24, 26, 45/88, 89; 417/89

[56] References Cited

U.S. PATENT DOCUMENTS

| | | | |
|---|---|---|---|
| 2,541,831 | 2/1951 | Prince | 192/84 |
| 3,093,080 | 3/1961 | Tarifa et al. | 103/5 |
| 3,671,136 | 2/1970 | O'Mara et al. | 415/89 |
| 3,776,658 | 12/1973 | Erickson | 415/88 |
| 3,795,459 | 3/1974 | Erickson et al. | 415/89 |
| 3,817,659 | 6/1974 | Erickson et al. | 417/84 |
| 3,936,214 | 2/1976 | Zupanick | 415/89 |
| 4,280,790 | 7/1981 | Crichlow | 415/89 |
| 4,679,980 | 7/1987 | Bland | 415/24 |

*Primary Examiner*—Edward K. Look
*Assistant Examiner*—Todd Mattingly
*Attorney, Agent, or Firm*—Marshall, O'Toole, Gerstein, Murray & Bicknell;

[57] ABSTRACT

A method of operating a pitot pump that pressurizes a first fluid of a first viscosity and first density wherein the pump includes a rotatable housing and a stationary probe disposed within the housing includes the steps of providing a source of a second fluid having a second viscosity and second density less than the first viscosity and first density, detecting a physical condition in the housing indicative of the presence of the first fluid at a second radial position inside the first radial position and connecting the source of the second fluid to an inner annular chamber of the housing when the detected physical condition indicates that the first fluid is present at the second radial position.

10 Claims, 2 Drawing Sheets

LOW DRAG PITOT PUMP AND METHOD OF OPERATING SAME

TECHNICAL FIELD

The present invention relates generally to pumps of the centrifugal type, and more particularly to a pitot pump.

BACKGROUND ART

Pitot pumps are often used when fluids of high pressures and low flow rates are to be delivered to a utilization device. Conventional pitot pumps utilize a fixed probe having an inlet comprising a hole disposed in a tip of the probe and an outlet wherein the cross sectional area of the probe flow path increases from the inlet to the outlet. The probe and probe tip are disposed in a body of rotating fluid within a rotating housing such that the hole in the probe tip faces the flow of rotating fluid. The fluid is diffused after entering the probe to convert dynamic pressure into static pressure.

Pitot pumps typically experience drag losses due to flow of the liquid in the housing past the probe. Prior attempts at reducing these drag losses have focused primarily on probe geometry and cross sectional configuration. By streamlining the probe, significant reduction in drag losses can be accomplished.

Bland, U.S. Pat. No. 4,679,980, assigned to the the assignee of the instant application, discloses an inventory control device for a two-phase flow system. The device utilizes a pitot pump comprising a rotating housing, a conventional pitot tube stationarily mounted within the rotating housing and a second pitot tube in fluid communication with an accumulator. During operation of the pitot pump, liquid is disposed in an annular space surrounding vapor within the rotating housing. A pressure relation is established using the accumulator whereby the second pitot tube and the accumulator maintain a constant level of liquid within the rotating housing of the pitot pump. The fluid level is controlled for the purpose of achieving good centrifugal separation of gas and vapor or for the purpose of maintaining constant angular momentum of the rotating housing.

Tarifa, U.S. Pat. No. 3,093,080 discloses a pitot pump wherein an inlet into a rotating housing of the pump rotates at a speed of about one-half the housing speed to inject fluid smoothly into the partially filled housing without disturbing the free surface. The level of the liquid of the rotating housing is controlled by either a hydrodynamic shoe actuated throttle plate or by a reverse scoop which disturbs the incoming flow.

Zupanick, U.S. Pat. No. 3,936,214 discloses a pitot pump which may be used as a centrifugal separator. A stationary arm is disposed within a rotating housing containing two-phase fluid flow. The stationary arm includes a first orifice at an outward end of the arm and a second orifice at an inwardly disposed position of the arm. A sensor is used to detect the type of fluid being received at the second orifice. If the fluid is liquid, a control valve closes the exit passage in fluid communication with the second orifice and the speed of rotation or rate of mixed phase fluid flow into the pump is altered to achieve proper balance between phases.

O'Mara, U.S. Pat. No. 3,671,136, Erickson, U.S. Pat. No. 3,776,658, Erickson, et al., U.S. Pat. No. 3,795,459, Erickson, et al., U.S. Pat. No. 3,817,659 and Crichlow, U.S. Pat. No. 4,280,790 disclose pitot pumps wherein one or more pitot tubes are disposed in a rotating chamber or housing.

Prince, U.S. Pat. No. 2,541,831 discloses a rotating magnetic clutch assembly wherein centrifugal forces are utilized to remove fluids in a space between relatively rotatable members to prevent viscous drag when the clutch is disengaged.

SUMMARY OF THE INVENTION

In accordance with the present invention, a pitot pump is operated to reduce frictional losses caused by drag.

More particularly, a method of operating a pitot pump which pressurizes a first fluid of a first viscosity and first density wherein the pump includes a rotatable housing having an inner annular chamber containing the first fluid and a quantity of a second fluid having a second viscosity and a second density less than the first viscosity and the first density, respectively, and wherein a stationary probe is disposed within the housing having a radially extending body terminating at an open tip disposed at a first radial position within the chamber includes the step of detecting a physical condition in the housing as the housing is rotating indicative of the presence of the first fluid at a second radial position inside the first radial position wherein the second radial position intercepts the probe body at an intermediate portion thereof. The method further includes the step of controlling the quantity of second fluid in the inner annular chamber in response to the detected physical condition whereby the first fluid occupies a space in the chamber outside of the second radial position and the second fluid occupies the space in the chamber inside of the second radial position.

Preferably, the first fluid is a liquid and the second fluid is a gas. Also preferably, the step of detecting includes the step of sensing pressure in the housing at the second radial position. In accordance with one aspect of the present invention, the step of sensing includes the step of developing first and second pressure signals representing total pressure and static pressure, respectively, at the second radial position. The first and second pressure signals may comprise fluidic signals and the step of controlling includes the step of providing the first and second pressure signals to first and second input ports, respectively, of a shuttle valve wherein the shuttle valve includes a third input port coupled to the source of second fluid and an output port coupled to the chamber. Preferably, the source of second fluid comprises a pressurized air source.

In accordance with a further aspect of the present invention, the step of controlling includes the steps of providing the first and second pressure signals to first and second input ports, respectively, of a shuttle valve wherein the shuttle valve includes a third input port coupled to a pressurized fluid source and an output port and providing an air ejector having a first input that receives ambient air, a second input coupled to the output port of the shuttle valve and an output coupled to the housing wherein the second input of the air injector receives pressurized fluid from the pressurized fluid source and the shuttle valve when the first fluid is present at the second radial position, such pressurized fluid causing the air ejector to inject the ambient air into the chamber.

In accordance with yet another aspect of the present invention, a pitot pump for pressurizing a liquid includes a rotatable housing having an annular chamber therein in fluid communication with a pump inlet wherein the pump inlet is adapted for connection to a source of liquid and wherein the rotatable housing causes liquid to flow in a circular path within an annular liquid-filled chamber portion surrounding an air-filled chamber portion. A pitot probe is disposed within a housing having an axially extending portion disposed in the air-filled chamber portion and a radially extending portion joined to the axially extending portion and terminating at an open tip submerged in the liquid-filled chamber portion. A channel extends through the probe and provides fluid communication between the open tip and a pump outlet. Means are operable when the housing is rotating and fluid is disposed in the chamber for injecting air into the chamber when liquid is present at a certain radial position along the radially extending probe portion whereby the depth to which the probe tip is submerged in the liquid is controlled.

Preferably, the injecting means includes a total pressure tap and a static pressure tap both of which are disposed in the probe at the certain radial position and a valve responsive to the pressure taps for controlling the admittance of pressurized air to the chamber. Further in accordance with a highly preferred form of the invention, the valve comprises a shuttle valve having a first input port coupled to the total pressure tap, a second input port coupled to the static pressure tap, a third input port coupled to a source of pressurized air and an output port coupled to the pump inlet.

In accordance with an alternative embodiment of the present invention, the valve is of the shuttle type and includes a first input port coupled to the total pressure tap, a second input port coupled to the static pressure tap, a third input port coupled to a source of pressurized liquid and an output port. An air ejector includes a first input that receives ambient air, a second input that receives pressurized liquid from the output port of the shuttle valve and an output coupled to the pump inlet whereby the ejector injects ambient air into the chamber when liquid is present at the certain radial position.

The present invention substantially reduces frictional drag losses in the pump by replacing relatively high viscosity and high density liquid with low viscosity and low density air such that the probe tip is submerged in the rotating liquid only to the depth necessary to insure proper operation of the pump. The efficiency of the pump is thus increased in a simple and effective manner.

DESCRIPTION OF THE PREFERRED EMBODIMENTS

Figure 1:
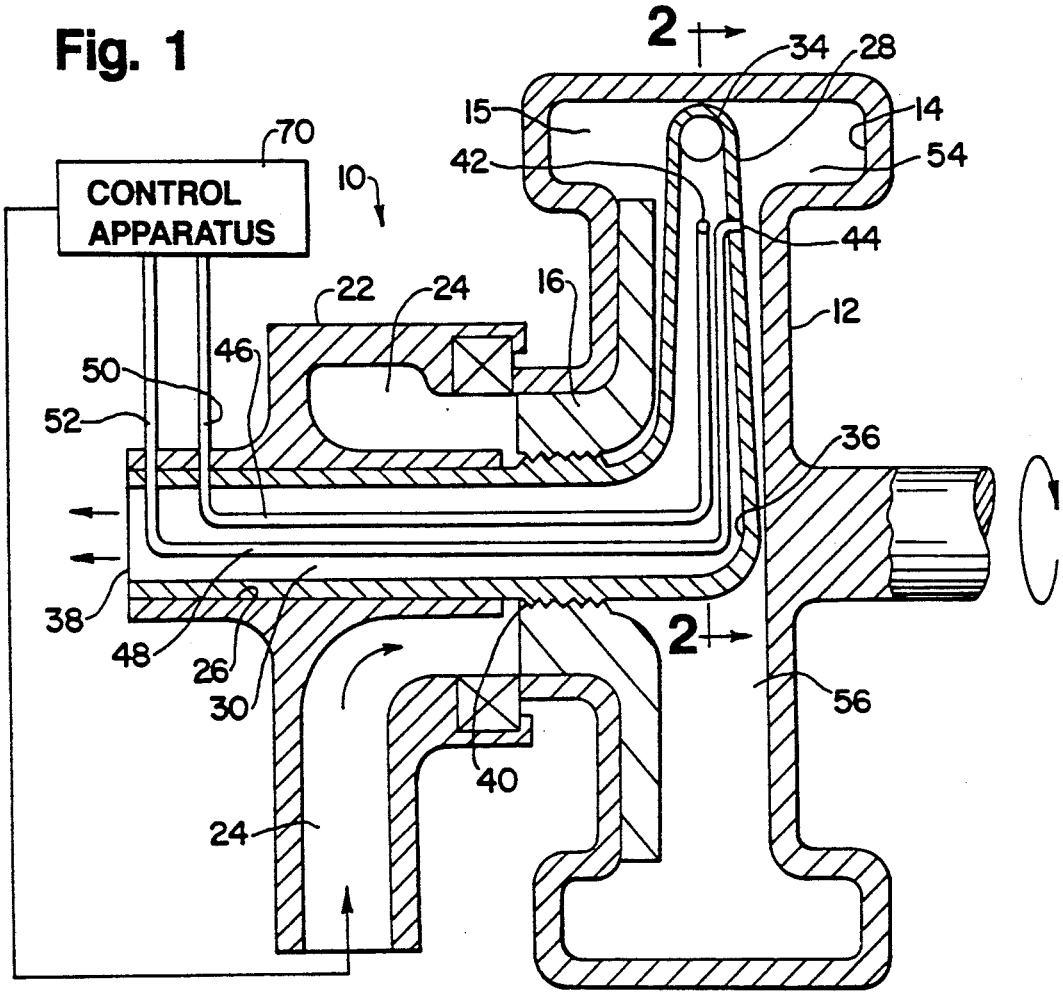
FIG. 1 comprises a full sectional view of a pitot pump according to the present invention.
Figure 2:
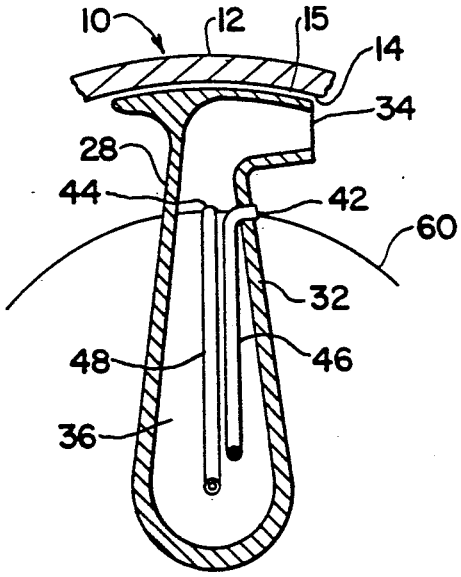
FIG. 2 comprises a sectional view taken generally along the lines 2—2 of FIG. 1.

Referring now to FIGS. 1 and 2, a pitot pump 10 includes an annular rotating housing 12 which is driven by a prime mover (not shown) such as an aircraft jet engine. The rotating housing 12 includes an annular chamber 14 therein having a relatively wide channel 15 at a radially outward location for a purpose to be described hereinafter.

The rotating housing further includes an impeller 16. The impeller 16 may have a series of blades or a series of radial ribs having radial holes or slots therein.

The rotating housing 12 is mounted on a stationary housing 22. The stationary housing 22 includes a pump inlet 24 which is in turn disposed in fluid communication with the impeller 16. The stationary housing 22 further includes a bore 26 therein within which is mounted a stationary pitot probe 28. The probe 28 includes an axially extending portion 30, a radially extending portion 32 joined to the axially extending portion 30 and terminating at an open tip 34 and a channel 36 therethrough providing fluid communication between the open tip and a pump outlet 38. A labyrinth seal 40 is disposed between the impeller 16 and the stationary pitot probe 28. A different seal, such as a face seal or a lip seal, may be substituted for the labyrinth seal 40, if desired.

The pitot probe 28 further includes a total or stagnation pressure tap 42 and a static pressure tap 44 both of which are disposed at a certain radial position along the length of the radially extending portion 32 of the pitot probe 28. The pressure taps 42, 44 are connected by conduits 46, 48, respectively to exterior ports 50, 52, respectively. The conduits 46, 48 extend through the channel 36 within the pitot probe 28. As will become evident hereinafter, the probe portions 30, 32 may be widened to accommodate the conduits 46, 48 without substantially increasing drag losses.

During operation of the pitot pump 10, fluid of a first viscosity and density, typically a liquid such as jet fuel, is provided to the pump inlet 24 as the rotating housing 12 is rotated by the prime mover. A rotating body of liquid accumulates at a radially outward annular portion 54 of the chamber 14 and flows in a circular path due to rotation of the rotating housing 12. Within the annular liquid-filled chamber portion 54 is a chamber portion 56 filled with a second fluid of relatively low viscosity and density. Typically, this second fluid comprises a gas, such as air, which has a lower viscosity and density than the viscosity and density, respectively, of the liquid accumulated in the chamber portion 54.

An interface 60 between the liquid-filled chamber portion 54 and the gas-filled chamber portion 56 is disposed within the chamber 14. The radial position of the interface 60 is controlled as noted in greater detail hereinafter such that only a small portion of the radially extending portion 32 of the probe 28 is submerged in the liquid so that contact of the probe 28 with the relatively high drag imparting liquid is minimized. At the same time, enough of the radially extending portion 32 is submerged in the liquid to ensure proper operation of the pitot pump 10.

The radial position of the interface 60 is controlled by control apparatus 70 that is responsive to total and static pressure signals developed by the taps 42, 44 and transmitted by the conduits 46, 48. The control apparatus 70 controls the admittance of a pressurized fluid into the chamber portion 56. More particularly, when liquid is located at the certain radial position covering the taps 42, 44, the ram pressure of the liquid produces a higher pressure at the total pressure tap 42 than at the static pressure tap 44. The control apparatus 70 detects this difference in pressures and injects pressurized air into the pump inlet 24. The pressurized air is transmitted via the passages of the impeller 16 and the liquid in the chamber portion 54 into the chamber portion 56. Alternatively, air may be injected directly into the chamber portion 56. The control apparatus 70 continues to supply pressurized air to the pump inlet 24 until the interface 60 moves radially outward of the certain radial position at which the taps 42 and 44 are located. Upon this occurrence, the total and static pressures detected at the taps 42, 44 become substantially equal due to the lower density of the air. The control apparatus 70 detects this absence of pressure differential and discontinues the supply of pressurized air to the pump inlet 24.

During operation of the pitot pump, air dissolved in the liquid within the chamber 14 is swept through the open tip 34 of the probe 28. Also, leakage occurs past the labyrinth seal 40 during operation. Eventually, enough air is removed such that the interface 60 again moves to a position radially inward of the certain radial position. The control apparatus 70 thus detects a differential between the total and static pressures and provides pressurized air as before to force the interface 60 radially outward.

It can be seen that the control apparatus 70 controls the position of the radial position of the interface 60 such that liquid is disposed outwardly of the certain radial position and air is disposed radially inward of the certain radial position.

Figure 3:
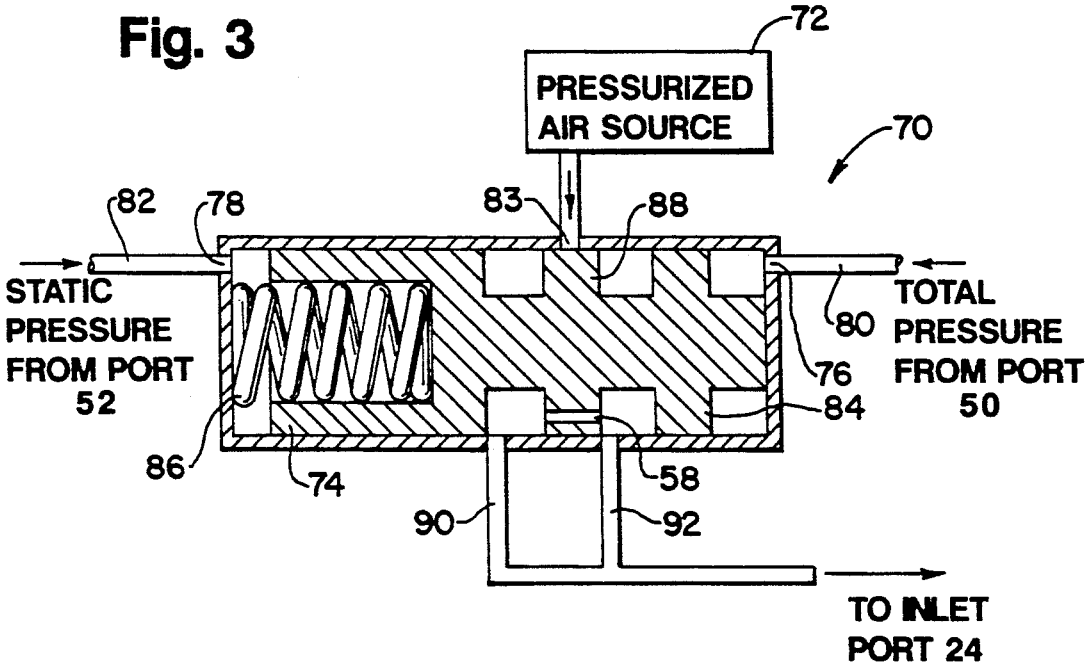
FIG. 3 comprises a sectional diagrammatic view of a first type of control apparatus for controlling the admittance of pressurized air into the pitot pump of FIGS. 1 and 2.

Referring now to FIG. 3, there is illustrated a first embodiment of the control apparatus 70 of FIG. 1. The control apparatus 70 includes a source of pressurized fluid in the form of a pressurized air source 72 and a shuttle valve 74. An input port 83 is coupled to the air source 72. The shuttle valve 74 includes first and second input ports 76, 78 which in turn receive the total and static pressure signals over conduits 80, 82 coupled to the exterior ports 50, 52, respectively. The shuttle valve 74 further includes a spool 84 which is axially movable and which is biased toward the right as seen in FIG. 3 by a spring 86. When air is present at the certain radial position such that no substantial pressure differential is applied across the input ports 76, 78, the force developed by the spring 86 is unopposed and a land 88 of the spool 84 blocks the flow of pressurized air from the air source 72 to at least one and preferably two outlet conduits 90, 92. The conduits 90, 92 are in turn coupled in fluid communication with the pump inlet port 24. When the interface 60 is radially inside of the certain radial position, the pressure differential detected at the taps 42, 44 is applied across the input ports 76, 78 of the shuttle valve 74. This pressure differential counteracts the force exerted by the spring 86 and moves the spool 84. The land 88 is thus moved away from the input port 83 to permit pressurized air to flow from the air source 72 to the outlet conduits 90, 92. A hole 58 in the land 88 assures that air can exit through both conduits 90 and 92 to exhaust any internal leakage.

When the interface 60 again moves radially outward such that it is beyond the certain radial position, the pressure differential across the first and second input ports of the shuttle valve 74 disappears, in turn removing the force opposing the spring 86 and allowing the spool 84 to move to the right and disconnect the air source 72 from the outlet conduits 90, 92.

Figure 4:
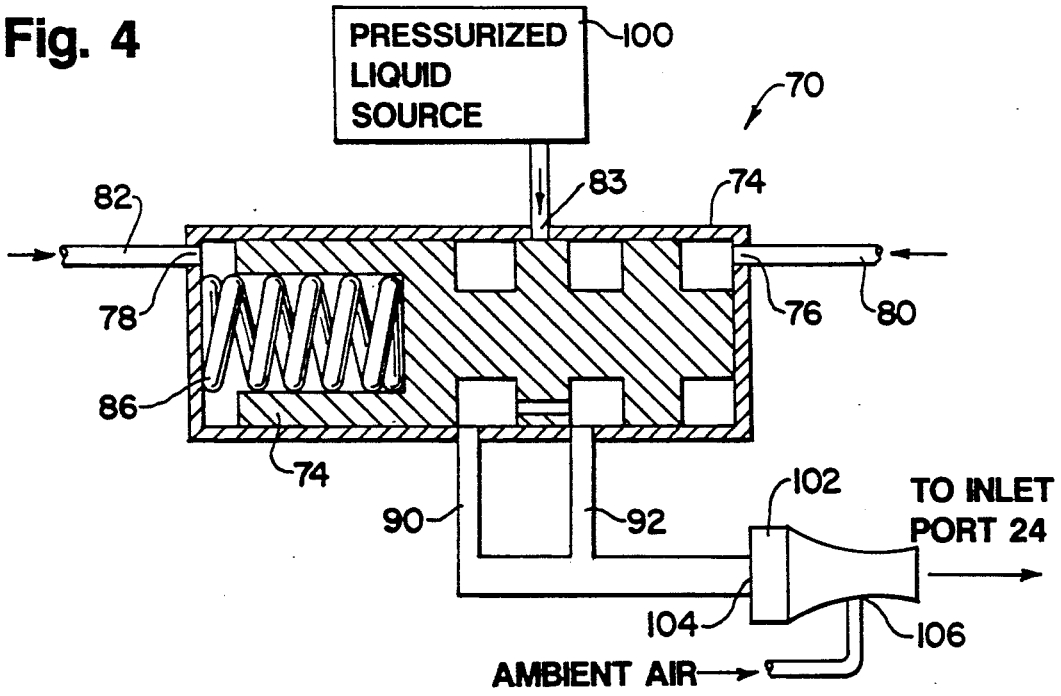
FIG. 4 is a view similar to FIG. 3 of a further type of control apparatus for controlling the admittance of pressurized air into the pitot pump of FIGS. 1 and 2.

FIG. 4 illustrates a different type of control apparatus 70 for use with the pitot pump of FIGS. 1 and 2 which is useful in applications where a source of pressurized air is not readily available. In this embodiment, the shuttle valve 74 is utilized together with a source of pressurized liquid 100 which is coupled to the input port 83. If desired, the source 100 may comprise a liquid source separate from the pump 10 or may comprise the pump 10 itself, in which case the input port 83 is coupled to the pump outlet 38. As before, when no pressure differential is applied across the input ports 76, 78, the spring 86 forces the spool to the position shown in FIG. 4 wherein the pressurized liquid source 100 is disconnected from the outlet conduits 90, 92. However, when the interface 60 is disposed radially inward from the certain radial position, the pressure differential developed by the taps 42, 44 is applied across the spool 74, in turn causing the spool to move and thereby connect the pressurized liquid source 100 to the conduits 90, 92. Pressurized liquid is thus applied to one input of an ejector 102. The ejector 102 includes a second input 106 that receives ambient air. The ejector 102 compresses the ambient air in response to receipt of pressurized fluid from the source 100 and injects the compressed ambient air into the inlet port 24.

As before, when the air-liquid interface 60 moves radially outward of the certain radial position, the pressure differential across the first and second shuttle valve input ports 76, 78 disappears, in turn allowing the spring to move the spool 84 and thus disconnect the pressurized liquid source 100 from the outlet conduits 90, 92. In response thereto, the ejector 102 ceases the injection of pressurized air into the inlet port 24.

As noted previously, the chamber 14 includes a relatively wide channel 15 at its outermost periphery. This ensures that a relatively large liquid volume is provided at this location so that temporary air expansion within the chamber portion 56 due to interruption of liquid flow will not cause the open tip 34 of the probe 28 to be uncovered and thus disturb pump outlet flow.

It should be noted that further modifications can be effected to the apparatus shown in FIGS. 3 and 4 without departing from the spirit and scope of the invention. For example, the fluidic control apparatus 70 may be replaced by an electrically operated servovalve which is responsive to electrical signals developed by pressure transducers that detect the total and static pressures at the certain radial position. Other types of hydraulic, mechanical and electrical devices could alternatively be used in place of the devices shown in FIGS. 3 and 4 to effect the same result.

In each of the foregoing embodiments, the radial position of the air-liquid interface 60 is controlled so that only as much of the probe tip 34 is submerged in the liquid as is necessary to assure proper operation. Efficiency is thereby increased owing to reduced drag losses and the probe can be widened as necessary to accommodate the conduit 46, 48 without substantially increasing drag losses, as noted above.

As an alternative to the foregoing, rather than adding air to maintain the position of the air-liquid interface 60 at the desired radial position, it should be noted that air could alternatively be removed as needed to maintain such position. In this case, a mixture of fluid with excess air would be provided to the chamber 14 and air would be bled off as necessary through a port in fluid communication with the chamber portion 56. Preferably, although not necessarily, such excess air could be removed via a conduit parallel to the conduits 46, 48 and disposed in fluid communication with the chamber portion 56.

As a still further alternative, the conduit parallel to the conduits 46, 48 in fluid communication with the chamber portion 56 may be used to supply pressurized air to the chamber portion 56 in the first embodiments described above. By providing compressed air through this conduit rather than the pump inlet 24, a more stable liquid-gas interface may be achievable.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

We claim:

1. A method of operating a pitot pump which pressurizes a first fluid of a first viscosity and first density wherein the pump includes a rotatable housing having an inner annular chamber containing the first fluid and a quantity of a second fluid having a second viscosity and second density less than the first viscosity and first density, respectively, a stationary probe disposed within the housing and having a radially extending body terminating at an open tip disposed at a first radial position within the chamber and a channel therethrough providing fluid communication between the open tip and a pump outlet, comprising the steps of:

detecting a physical condition in the housing as the housing is rotating indicative of the presence of the first fluid at a second radial position inside the first radial position wherein the second radial position intercepts the probe body at an intermediate portion thereof, wherein the step of detecting includes the step of sensing pressure in the housing at the second radial position and wherein the step of sensing includes the steps of developing first and second pressure signals representing total pressure and static pressure, respectively, at the second radial position; and controlling the quantity of second fluid in the inner annular chamber in response to the detected physical condition whereby the first fluid occupies a space in the chamber outside of the second radial position and the second fluid occupies a space in the chamber inside of the second radial position.

2. The method of claim 1, wherein the first and second pressure signals comprise fluidic signals and the step of controlling includes the step of providing the first and second pressure signals to first and second input ports respectively, of a shuttle valve wherein the shuttle valve includes a third input port coupled to the source of second fluid and an output port coupled to the chamber.

3. The method of claim 2, including the further step of providing a source of second fluid wherein such source comprises a pressurized air source.

4. The method of claim 1, wherein the first and second pressure signals comprise fluidic signals and the step of controlling includes the steps of providing the first and second pressure signals to first and second input ports, respectively, of a shuttle valve, coupling a third input port of the shuttle valve to a pressurized fluid source and providing an air ejector having a first input that receives ambient air, a second input coupled to an output port of the shuttle valve and an output coupled to the housing wherein the second input of the air injector receives pressurized fluid from the pressurized fluid source and the shuttle valve when the first fluid is present at the second radial position, such pressurized fluid causing the air ejector to inject the ambient air into the chamber.

5. The method of claim 1, wherein the step of coupling includes the step of providing a fluid connection between a total pressure tap located at the second radial position and the third input port of the shuttle valve.

6. A pitot pump for pressurizing a liquid, comprising:

a rotatable housing having an annular chamber therein in fluid communication with a pump inlet wherein the pump inlet is adapted for connection to a source of liquid, the rotatable housing causing liquid to flow in a circular path within an annular liquid-filled chamber portion surrounding an air-filled chamber portion;

a pitot probe disposed within the housing having an axially extending portion disposed in the air-filled chamber portion, a radially extending portion joined to the axially extending portion and terminating at an open tip submerged in the liquid-filled chamber portion and a channel therethrough providing fluid communication between the open tip and a pump outlet; and means operable when the housing is rotating and fluid is disposed in the chamber for injecting air into the chamber when liquid is present at a certain radial position along the radially extending probe portion whereby the depth to which the probe tip is submerged in the liquid is controlled.

7. The pitot pump of claim 6, wherein the injecting means includes a total pressure tap and a static pressure tap both of which are disposed in the probe at the certain radial position and a valve coupled to the pressure taps for controlling the admittance of pressurized air to the chamber.

8. The pitot pump of claim 7, wherein the valve comprises a shuttle valve having a first input port coupled to the total pressure tap, a second input port coupled to the static pressure tap, a third input port coupled to a source of pressurized air and an output port coupled to the pump inlet.

9. The pitot pump of claim 7, wherein the valve comprises a shuttle valve having a first input port coupled to the total pressure tap, a second input port coupled to the static pressure tap, a third input port coupled to a source of pressurized liquid and an output port and further including an air ejector having a first input that receives ambient air, a second input that receives pressurized liquid from the output port of the shuttle valve and an output coupled to the pump inlet whereby the ejector injects ambient air into the chamber when liquid is present at the certain radial position.

10. The method of claim 1, wherein the first fluid is a liquid and the second fluid is a gas.

* * * * *